United States Patent [19]

Fitzgibbon, Jr.

[11] Patent Number: 4,913,233

[45] Date of Patent: Apr. 3, 1990

[54] METHODS OF FIELD BLASTING OF EARTH FORMATIONS USING INFLATABLE DEVICES FOR SUSPENDING EXPLOSIVES IN BOREHOLES

[76] Inventor: Daniel F. Fitzgibbon, Jr., Rte. 3, Van Dyke Mill Rd., Taylorsville, Ky. 40071

[21] Appl. No.: 276,651

[22] Filed: Nov. 28, 1988

Related U.S. Application Data

[62] Division of Ser. No. 166,542, Mar. 10, 1988.

[51] Int. Cl.[4] ..... E21B 33/127

[52] U.S. Cl. ..... 166/285; 166/187; 166/192; 102/313

[58] Field of Search ..... 166/187, 179, 192, 285, 166/286, 191; 102/304, 311, 312, 313, 333; 138/93

[56] References Cited

U.S. PATENT DOCUMENTS

| | | | |
|---|---|---|---|
| 2,115,388 | 4/1938 | Heitzman | 102/304 |
| 3,276,481 | 10/1966 | McNulty | 138/93 |
| 3,357,193 | 12/1967 | Fitzgibbon, Jr. | 102/333 |
| 3,493,045 | 2/1970 | Bassani | 166/187 |
| 3,806,025 | 4/1974 | Marshall | 102/333 |
| 4,043,132 | 8/1977 | Zupanick | 138/93 |
| 4,545,622 | 10/1985 | Yang | 102/312 |
| 4,660,644 | 4/1987 | Egnor | 166/192 |
| 4,736,796 | 4/1988 | Arnall et al. | 166/286 |

*Primary Examiner*—Jerome W. Massie, IV
*Assistant Examiner*—Terry L. Melius

[57] ABSTRACT

The invention provides methods and apparatus useful primarily in the presplitting and blast removal of earth formations, the improvements according to the invention involving the use of inflatable devices suspended in boreholes used in shattering earth formations. The inflatable devices of the invention can be of various shapes and are provided with valves to allow a fluid such as air to be pumped into each device on placement of the device at a desired location in a borehole. The inflatable devices are preferably formed of a flexible, polymeric material which allows a desired degree of stretching to cause plugging of a borehole. The "plug" formed by an inflatable device of the invention allows loading of explosives into a borehole in order to produce desired blast results according to the several methods of the invention.

17 Claims, 12 Drawing Sheets

METHODS OF FIELD BLASTING OF EARTH FORMATIONS USING INFLATABLE DEVICES FOR SUSPENDING EXPLOSIVES IN BOREHOLES

This is a divisional of copending application Ser. No. 166,542, filed Mar. 10, 1988.

BACKGROUND OF THE INVENTION

1. Field of the Invention

The invention relates generally to methods for shattering earth formations by the detonation of explosives within boreholes formed in the earth formations. The invention specifically relates to inflatable devices used in the practice of the present methods for support of explosives and/or stemming within a borehole.

2. Description of the Prior Art

Various mining operations and earth removal operations are improved by a practice known as presplitting or shattering of earth formations in a controllable manner. As an example of a prior presplitting operation used in mining, a number of spaced boreholes are drilled in a formation which is to be shattered. Explosives are disposed within the boreholes and detonated to shatter the formation, thereby facilitating the removal of overburden to expose seams of material which is to be mined. Earth removal methods used for other purposes also have employed presplitting techniques. In operations of this nature, prior devices have been available in the art to "plug" boreholes drilled specifically for presplitting. Such devices have invariably been relatively expensive and relatively complicated in structure. Further, such prior devices are mechanically unable to support sufficient quantities of explosives and/or stemming necessary in presplitting boreholes of diameters approaching that of production boreholes. These prior devices are often incapable of adequately supporting explosives and/or stemming in even small diameter boreholes. Prior plugging devices employ structure such as plugged claws or the like which dig into a hole wall under the pressure surge of a blast. Other devices involve the mixing on site of foam generating reactive chemicals into an expandible rubber plug to achieve plugging of a hole. Similarly, wet drill holes ave been sealed with devices produced by DuPont (Australia) Ltd., these devices comprising two-layer polyethylene bags which contain two component polyurethane foam with the components packed separately as liquids in plastic bottles and sealed within the bags. Pressure applied to the liquid bottles within one of the DuPont bags causes lids to pop off of the bottles with a resulting mixture of the liquids, thereby forming polyurethane foam which hardens and causes the bag to expand against walls of the hole and to harden in place. Such devices as are described above are relatively expensive and require the handling of chemical materials. Further, after hardening of the foam materials within the device, the device cannot be subsequently reused or even repositioned or removed from the hole.

Temporary closure devices for boreholes have been provided by Fitzgibbon, Jr., in U.S. Pat. No. 3,357,193, these devices comprising inflatable, tubular structures which are inserted in a deflated condition into the upper end of a hole and inflated therein in order to temporarily close off the hole to prevent ingress of water, to prevent ice formation within the hole and to prevent blockage of the hole by undesirable material which can fall into an open hole. Further, the Fitzgibbon, Jr. devices prevent individuals from stepping into or falling into such holes with resulting injury.

However, the prior art has not provided an inexpensive borehole plugging device which can be either expendible or reusable according to the particular method of use. The invention provides for the first time such an inexpensive plugging device which can be rapidly and conveniently used in field blasting operations and which can be reused in many applications and even repositioned as desired within the borehole in the event that the plugging device is not initially positioned within the borehole in a satisfactory manner or in a desired location The relatively inexpensive nature of the present devices allows the practice of a variety of presplitting and blasting methods at a minimum of expense. The present devices and methods for their use thus constitute a significant and substantial advance in the art.

SUMMARY OF THE INVENTION

The invention provides inflatable devices disposable within boreholes formed in earth formations for suspending explosives and/or stemming materials within said boreholes to allow practice of methods for shattering the earth formations to effect presplitting or earth removal inter alia. The inflatable devices of the invention are positioned within boreholes in a deflated condition and are inflated at the desired location within the hole to seal or "plug" the hole for support of explosive columns and/or stemming columns. The devices of the invention can be formed of various flexible polymeric materials including polyvinylchlorides, low density polyethylenes, and polyurethane films in selected thicknesses. The flexible vinyls and polyethylenes exhibit desirable cost properties but are less desirable in that they lack low temperature flexure and tensile strength and are further more susceptible to abrasion and tearing than are aromatic polyether polyurethanes and polyester-based polyurethane films. The polyurethane materials, while more expensive, are more readily fabricated and endure the conditions of use more acceptably than competing materials. Primarily, the selected material forming the present inflatable devices must have the capability to stretch to a degree sufficient to cause the device to be firm within the borehole and yet resist continued stretching, particularly in directions along the longitudinal axis of the borehole which would cause the device to fall. The present inflatable devices can be shaped in various conformations including double-ended tubular conformations, disc-like conformations and "flat" square and rectangular conformations as examples. The inflatable devices are provided with valves which allow inflation of the devices through hoses connected to the valves while the devices are in place within the boreholes. Valves such as tire valves, oral valves, needle valves and the like are useful. However, valves such as needle valves are self-sealing and are readily connected to and disconnected from an air line such that the device can be lowered down into a borehole, inflated and then readily released from the air line. Valves such as oral valves typically require a protective flap when used with the devices of the invention.

The devices of the invention can be formed in differing sizes to accommodate boreholes of differing diameter. The disc-like conformations of the invention are preferably sized to be used in boreholes of three to five inch diameters such as have been conventionally used for presplitting. In such situations, columns of explosives or stemming are of lesser total weight than is the case with presplitting and production boreholes of diameters of approximately nine inches where explosive or stemming columns can weigh six to seven hundred pounds or more. Polyurethane film suitable for forming the present inflatable devices include films usually between 12 and 22 mils. However, thicknesses can exceed 40 mils.

The inflatable devices of the invention can be used in the practice of a variety of presplitting and earth removal or blasting methods to support explosive and/or stemming in a borehole for plugging the holes, for sealing off lateral fissures in the sides of holes and for sealing off the bottoms of boreholes where a drill bit has punched through old mineworks auger holes or the like. The present inflatable devices can also be used in methods involving vertical cratering retreat mining in either uphole or downhole loading situations. In vertical cratering techniques, particular inflatable devices according to the invention can be formed in doughnut shapes having loading tubing disposed through the center of the devices with accommodation being made according to usage for vent tubing and primer cords.

The inflatable devices and the methods of the invention are useful both in the practice of presplitting of earth formations prior to actual earth removal and also in actual earth removal by using the devices in "production" holes. The inflatable devices can be employed to support explosives and/or stemming in production holes for earth removal in a formation in order to maximize the efficiency of the explosives. In both presplitting and production blasting, the inflatable devices are of substantial utility when used to support a stemming column at or near the top of a borehole, the stemming column acting to contain energy for the explosives within the borehole and thus gain maximum benefit from the energy of the explosion. A particular benefit of the present device is the ability to drill presplitting holes with the same drilling equipment used to drill production holes. In this situation, the same drill and associated equipment used to drill production holes, typically nine inch holes, is used to drill the presplitting holes. Substantial operational savings accrue from the ability to use the same drilling equipment since separate drills are not necessary for drilling the conventionally larger production holes and the conventionally smaller presplitting holes. The present inflatable devices allow the use of larger diameter presplitting holes since said devices are capable of supporting the heavier columns, particularly stemming columns, occasioned by the larger diameter holes. The present devices can be used in production holes even though separate presplitting methods are not employed.

Accordingly, it is a primary object of the present invention to provide inflatable devices and methods useful in presplitting and production blasting of earth formations.

It is another object of the present invention to provide inflatable devices and methods useful in the presplitting of earth formations by suspension of the inflatable devices in boreholes to facilitate shattering of the earth formations.

It is another object of the present invention to provide inflatable devices and methods for their use wherein earth formations can be presplit or sheared between boreholes to facilitate removal of overburden and the like.

It is a further object of the invention to provide inflatable devices and methods for their use wherein lateral fissures in the sides of boreholes and "punch through" holes in the bottoms of boreholes can be sealed off or "plugged" to allow use of the hole without the dangers associated with disposition of excessive amounts of explosives within such fissures or within old mine shafts and/or auger holes.

A still further object of the invention is the provision of inflatable devices and methods for their use wherein vertical cratering retreat mining techniques can be utilized either in up hole or down hole loading of boreholes which are either pneumatically loaded or loaded by pumping of slurries or emulsions into said holes.

Yet another object of the invention is to provide inflatable devices and methods for their use which allows the use of the same drilling equipment to drill both presplitting and production boreholes.

Still further objects and advantages of the invention will become more readily apparent in light of the following detailed description of the preferred embodiments.

DESCRIPTION OF THE PREFERRED EMDODIMENTS

Figure 1A:
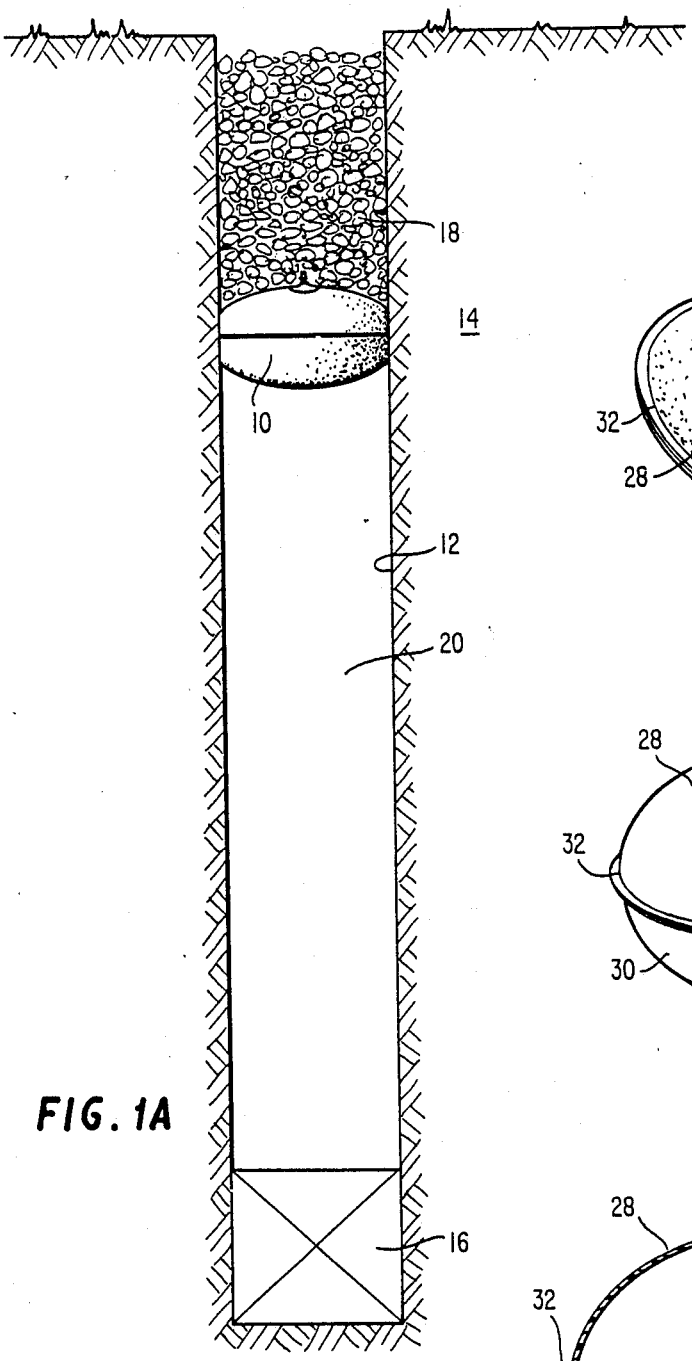
FIG. 1A is an idealized elevational view in partial section of an inflatable device according to the invention disposed within a borehole and spaced from an explosive charge disposed in the bottom of the borehole, the inflatable device being used as shown in the practice of a presplitting method according to the invention by plugging the borehole to suspend stemming material in the upper portion of the borehole and thus form an air gap between the explosive charge and the stemming material.
Figure 2:
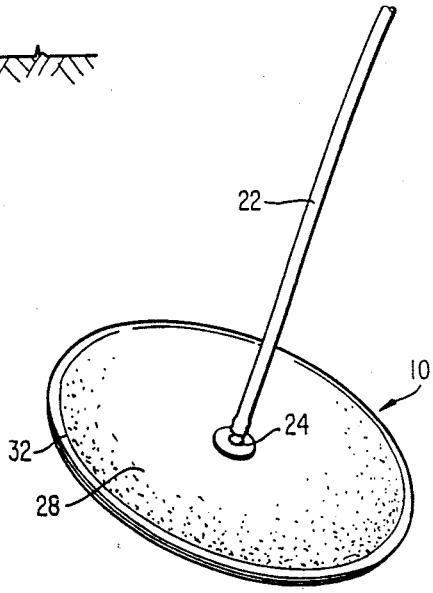
FIG. 2 is an idealized perspective view of an inflatable device according to the invention and formed in a disc-like conformation, the device being particularly useful for presplitting when disposed within relatively lower diameter boreholes, the device being shown in a deflated configuration prior to insertion within a borehole and with an inflation hose attached for inflation of the inflatable device once inserted into a borehole.

Referring now to the drawings and particularly to FIG. 1A, an inflatable device configured according to one embodiment of the invention is seen at 10 to be disposed in a supporting position within a borehole 12 which has been drilled into substrate 14. The substrate 14 comprises an earth formation which is to be presplit by the detonation of an explosive charge 16 disposed in the bottom of the borehole 12. The inflatable device 10 is seen to suspend or support stemming material 18 which comprises drill cuttings and the like which are shoveled into the borehole 12 after disposition of the inflatable device 10 at a desired location of the borehole. The inflatable device 10 can be lowered to any desired depth within the borehole 12 by connection of said device 10 to an air hose, such as is shown at 22 in FIG. 2, connected to a valve 24 such as is also seen in FIG. 2. The inflatable device 10 is inflated through the air hose 22 and valve 24 on disposition of the device 10 at a desired depth within the borehole. The inflatable device 10 is primarily used to support columns of explosives or columns of stemming materials such as the materials 18 within the borehole to allow detonation of explosives within the borehole to perform a useful function such as the presplitting of an earth formation prior to or almost simultaneously with the removal of overburden such as is accomplished by blasting in production holes as described hereinafter.

Figure 1B:
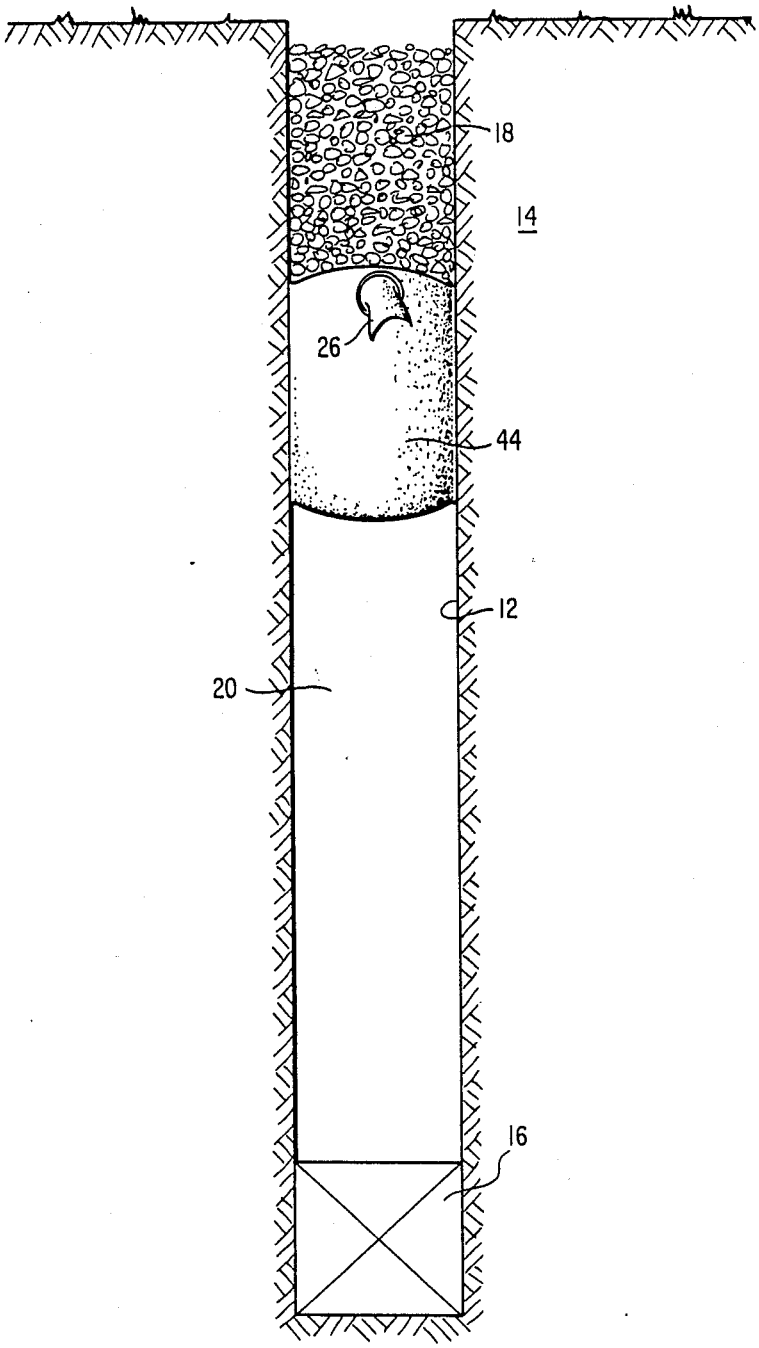
FIG. 1B is an idealized elevational view in partial section of another embodiment of the inflatable devices according to the invention disposed within a borehole and used for presplitting of an earth formation.
Figure 11:
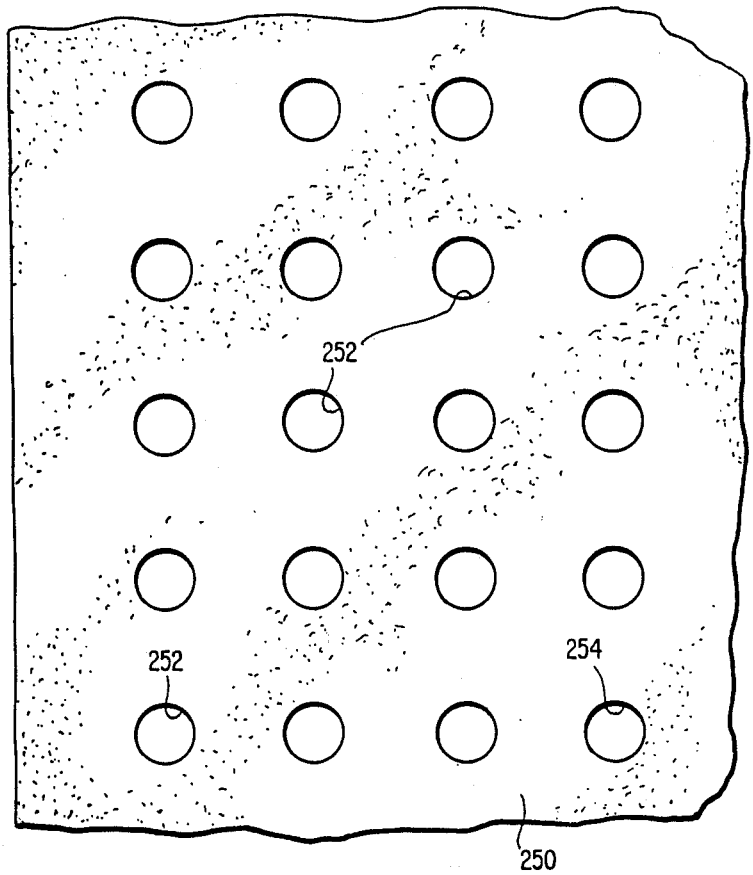
FIG. 11 is a diagram of a plurality of boreholes formed in a pattern in an earth formation.

The method primarily illustrated in FIG. 1A relates to the presplitting, shearing or "smooth walling" of an earth formation within which a plurality of holes such as the borehole 12 have been drilled in spaced relation to each other and in a desired geometrical configuration within the earth formation such that detonation of explosive charges such as the explosive charge 16 within the plurality of boreholes 12 forms a shear between holes to create a wall achieved by decoupling the explosions from the sides of the boreholes. The explosive charge 16 is typically loaded to a depth of approximately 5 feet in the bottom of the borehole 12, a desirable explosive being ammonium nitrate/fuel oil (ANFO) and the borehole 12 typically being 50 feet in length. The borehole 12 of FIG. 1A is shown for purposes of illustration as having a length less than would proportionally be the case in actual practice. The inflatable device 10 is lowered to a depth of approximately 7 to 8 feet below the top of the borehole 12 with the stemming material 18 then being shoveled into the borehole to the top of the hole. The stemming material 18 can be mounded about the top of the hole as desired. Air gap 20 is thus created between the explosive charge 16 and the inflatable device 10, the length of the air gap being approximately 37 feet. Detonation of the explosive charge 16 fills the air gap 20 with the gaseous products of the explosion, these gases expanding against the inflatable device 10 and against the stemming material 18 and the bottom of the borehole 12 to create a presplitting between the borehole 12 which is illustrated and the spaced boreholes formed in a pattern within the earth formation. Such a pattern is shown in FIG. 11 which will be described hereinafter. Typically, the plurality of boreholes 12 are formed in a straight line in order to facilitate creation of a relatively smooth wall from which overburden has been removed once production blasting is effected In the environment shown in FIG. 1A, the inflatable device 10 is sacrificed during the explosion. However, when used with an appropriate valve, the inflatable device 10 can be deflated and repositioned within the borehole 12 in the event that the inflatable device is improperly positioned if the improper positioning is noticed prior to disconnection from the air hose 22. Even after the air hose 22 is disconnected, the device 10 can be mechanically puncutred and easily removed from the borehole if it becomes necessary to position a device differently within the borehole. Accordingly, the inflatable device 10 can be readily positioned within a borehole. Referring now to FIG. 1B, an inflatable device 44 is seen to be positioned within a borehole 12 formed in an earth formation 14. The borehole 12 is provided with explosives 16 and stemming material 18 suspended by the inflatable device 44 in much the same manner as is described relative to the inflatable device 10 of FIG. 1A. However, in FIG. 1B, the inflatable device 44 is shown as any one of the inflatable devices shown best in FIGS. 6 through 9. While the length of air gap 20 can vary between the inflatable device 44 and the explosive 16, the arrangement of stemming 18, inflatable device 44 and explosives 16 is arranged as is shown in the idealized view of FIG. 1B.

As will be described hereinafter, a series of production boreholes can be provided in an earth formation in a pattern such as is described relative to FIG. 11 with explosives within each of the production boreholes being detonated according to standard practices. The production borehole typically has a diameter of approximately 9 inches. As is noted above, the presplitting borehole 12 of either FIG. 1A or FIG. 1B can also have a diameter of approximately 9 inches, thereby allowing use of the same drilling equipment to form both the presplitting boreholes and the production boreholes. Although the disc-like inflatable device 10 of FIG. 1A can be used in a borehole of a 9 inch diameter, the rectangular configuration of the inflatable device 44 is best used in a borehole of 9 inches or greater since the device 44 can support a greater weight of the stemming 18. Generally rectangular inflatable devices are shown also in FIGS. 6 through 9 and will be described hereinafter.

Figure 6:
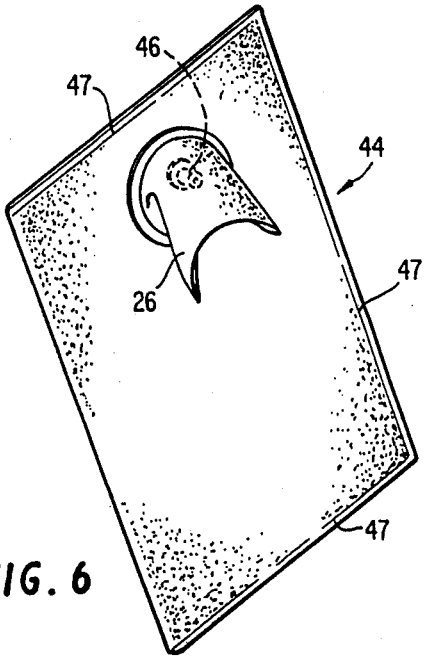
FIG. 6 is a perspective view of a substantially rectangular inflatable device according to the invention shown in a flat, deflated configuration prior to use.

The inflatable device 44 is also seen in FIG. 6 and is shown in FIGS. 1B and 6 to have a flap 26 which covers inflation valve 46. The inflation valve 46 is seen to be disposed on one panel of the device 44 and to extend in a direction generally perpendicular to the longitudinal axis of the device 44. When the inflation valve 46 comprises an oral inflation valve such as is produced by Halkey-Roberts, Inc. of St. Petersburg, Fla., a Division of Kidde Corporation, the flap 26 is necessary to reduce the potential for materials within the borehole 12 to contact the oral valve and cause the device 44 to deflate. Loose stemming materials such as the material 18, walls of the borehole 12 and other objects and surfaces can cause an oral valve to deflate by pressing against portions of the oral valve to allow release of inflating fluid from the device 44. It should be understood that other valves can be used which are not deflated by contact with obstructions However, an oral valve, such as is used on flatable life preservers and the like, has advantages in the present environment due to the fact that such oral valves allow very rapid inflation of the inflatable devices of the invention. Needle valves, also manufactured by Halkey-Roberts, Inc., do not require protective flaps to reduce the potential for deflation. However, such needle valves as are shown in FIGS. 1A, 2 through 4 and 9, do not allow inflation of the inflatable devices of the invention as rapidly as do the oral valve which is shown as the valve 46 inter alia.

The inflation valve 46 shown in FIG. 6 is seen to be disposed toward the upper portion of the inflatable device 44 as the device 44 will be inserted into the borehole 12, inflation of the device 44 causing expansion thereof with the valve 46 generally assuming a substantially upwardly disposed position on the device 44. An air hose (not shown in FIG. 6) which is generally similar to the air hose 22 of FIG. 2, is connected to the inflation valve 46 prior to disposition of the inflatable device 44 within the borehole 12. The inflatable device 44 is then lowered into the production borehole 12 of FIG. 1B to a desired position. It is to be understood that the borehole 12 can be approximately 50 feet in length or can be any other length as is desired according to a blasting situation. Once the inflatable device 44 is properly positioned, the device is inflated through the air hose (not shown) and the device 44 inflates to a "plugging" conformation or sealing conformation within said borehole 12. In a typical situation, the material forming the inflatable device 44 comprises a polymeric material such as is noted above and which is preferably of a thickness of between 12 and 22 mil. Such an inflatable device within a 9 inch diameter hole is usually inflated to a pressure of approximately 5 to 7 psig and is capable of supporting 600 to 700 pounds of stemming material. The pressure to which the inflatable device 44 is inflated is measured with a pressure gauge attached to a pressurized source of fluid as will be apparent to a person of ordinary skill in the art.

The inflatable device 44 is seen to be formed of a rectangular sheet of polymeric material as noted above with the sheet being folded upon itself to form the essentially rectangular conformation seen in FIG. 6. While the inflatable device 44 can be square in finished conformation, it is preferred to form the device 44 with a longer dimension in the vertical direction as the device 44 fits into the borehole 12. The "folded over" front and back panels of the device 44 are sealed together along free edges 47 such as by heat sealing according to practices which are conventional in the art. The flap 26 is attached to the device 44 by heat sealing or by any other expedient which is convenient.

Figure 7A:
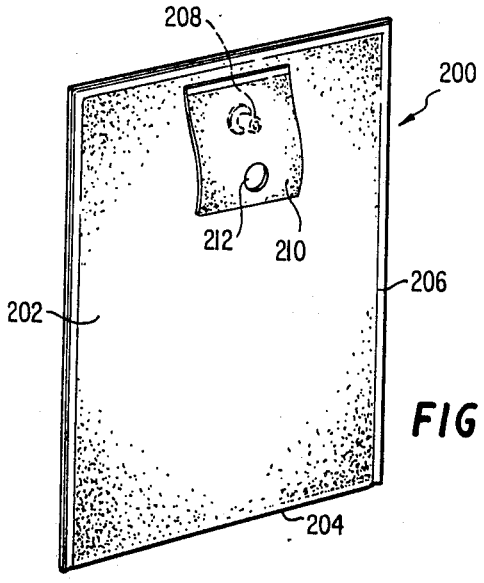
FIG. 7A is a perspective view of a further embodiment of a substantially rectangular inflatable device according to the invention.
Figure 7B:
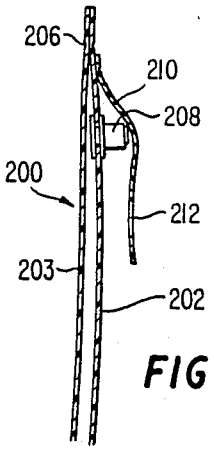
FIG. 7B is a detailed elevational view in partial section of the device of FIG. 7A.

Referring now to FIGS. 7A and 7B, a further embodiment of a substantially rectangular inflatable device is seen at 200 to be formed from a single sheet of polymeric material which is folded upwardly about edge 204 and sealed along edge 206, the sealing edge 206 comprising the two vertical sides of the device 200 and the uppermost side of said device 200 when the device is placed within a borehole. Front panel 202 of the device 200 has inflation valve 208 formed therein, this inflation valve being shown as an oral inflation valve. Opposite panel 203 of the device 200 is formed by the simple folding over of the single sheet of polymeric material. In the inflatable device 200, the lower edge 204 is the edge which is not sealed, this configuration typically resulting in an inflatable device which is more resistant to splitting in the event that a relatively unskilled technician overinflates the device 200.

The front panel 202 of the device 200 is further provided with a flap 210 having an aperture 212 formed therein. The aperture 212 is disposed at the lower portion of the flap 210 and spaced from the valve 208, the valve 208 being located on the front panel 202 near the upper edge of said inflatable device 200. When the inflatable device 200 is connected to an air hose (not shown) by fitting of said air hose over that portion of the valve 208 external of the front panel 202, the distal end of the air hose is fitted through the aperture 212 and onto the valve 208. The flap 210 is displaced upwardly to allow such a connection. After inflation of the device 200, the air hose is pulled from the valve and the flap 210 acts to assume a protective position over the valve 208.

Figure 8A:
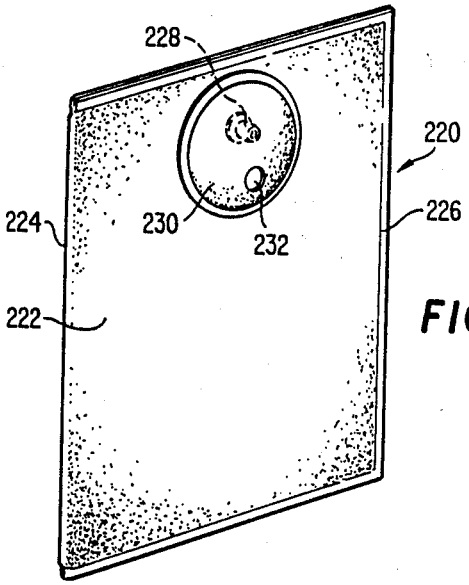
FIG. 8A is a perspective view of another embodiment of a substantially rectangular inflatable device according to the invention.
Figure 8B:
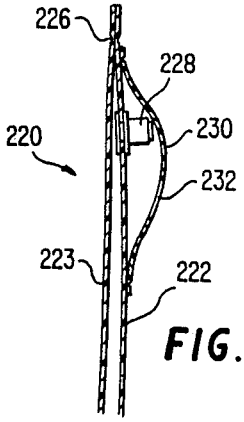
FIG. 8B is a detailed elevational view in partial section of the device of FIG. 8A.

In FIGS. 8A and 8B, an inflatable device 220 is seen to have front and rear panels 222 and 223, respectively, with a circular flap 230 disposed on the front panel 222 to cover inflation valve 228. The inflation valve 228 is again an oral inflation valve as is described above. The circular flap 230 is sealed to the front panel 222 about the perimeter thereof to more positively hold the flap 230 over the valve 228. An aperture 232 formed in a lower portion of the flap 230 is positioned over the valve 228 by displacement of the flap 230 in an upward direction to allow connection of an air hose (not shown) to the valve 228 to allow inflation of the inflatable device 220. Removal of the air hose from the valve 228 on completion of inflation acts to allow the flap 230 to reassume the position shown in FIG. 8B and therefore act to protect the valve 228.

The inflatable device 220 is formed of a rectangular sheet of polymeric material as is described relative to FIG. 6, the sheet being folded over upon itself and sealed along free edges 226, edge 224 being a continuous edge which is not sealed. As such, the body of the inflatable device 220 is essentially identical to that of the inflatable device 44 of FIG. 6.

Figure 9:
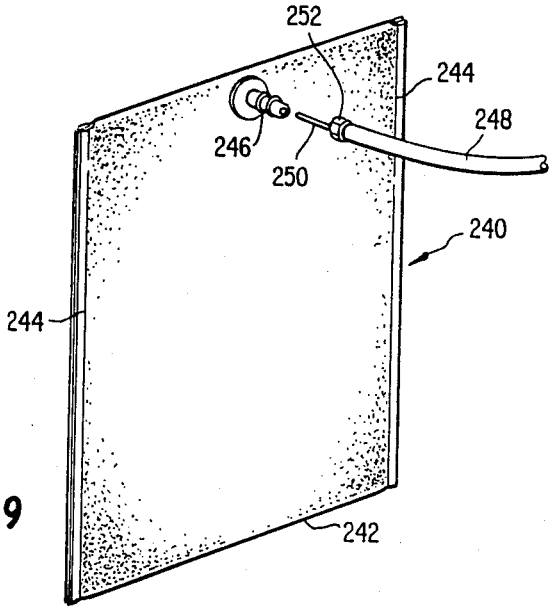
FIG. 9 is a perspective view of yet another embodiment of a substantially rectangular inflatable device according to the invention.

Referring now to FIG. 9, inflatable device 220 is formed from a flexible "tube" of polymeric material such that only open ends are sealed together at 244 to form the device. The sealed edges 244 are vertically disposed on the device 240 when said device is inserted into a borehole. Upper and lower edges, such as the edges 242, are continuous and are not sealed. The inflatable device 240 is provided with a needle valve 246 which does not require a protective flap To inflate the device 240, an air hose 248 is provided with a fitting 252 and a needle 250 which is inserted into the needle valve 246. After sufficient inflation, the air hose 248 is pulled from connection with the valve 246

Figure 5:
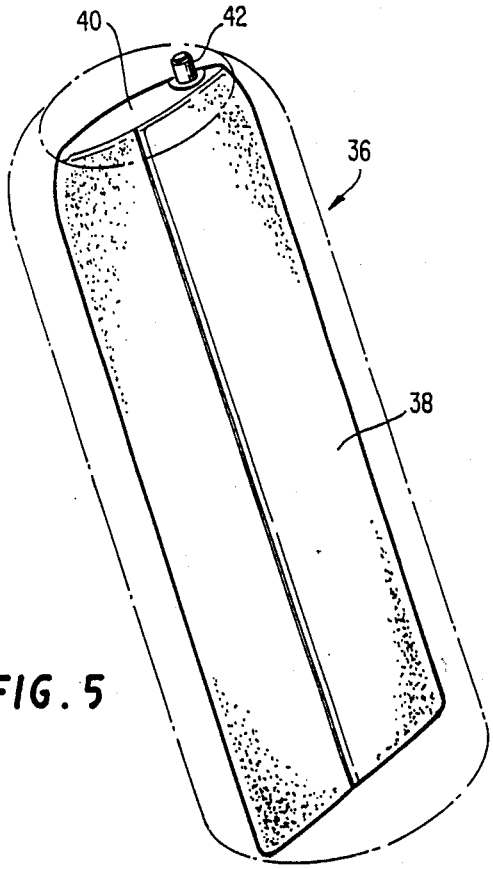
FIG. 5 is a perspective view of a tubular inflatable device according to the invention.

It should be understood that the inflatable devices shown in FIGS. 1B and 6 through 9 can be utilized in boreholes for presplitting or for production blasting. It should further be understood that the disc-like inflatable device 10 can also be used in these blasting environments. Inflatable devices having differing conformation from those described above are also useful, an example being the inflatable device 36 of FIG. 5, this device having a "toothpaste tube" conformation wherein body 38 is formed of a single sheet of polymeric material which is sealed along a vertical side and also along a lower edge A substantially circular panel 40 of polymeric material is sealed to the upper opening thus formed in the inflatable device 36. An inflation valve 42 can be provided on the panel 40, thereby acting to locate the valve 42 in an uppermost location on the device 36. Manufacture of the device 36 is more expensive due to the necessity for the heat sealing or welding of the panel 40 to the body 38 coupled with heat sealing of the "toothpaste tube" body 38. Reference is made to U.S. Pat. No. 3,357,193, which is incorporated hereinto by reference, and which describes the manufacture of a cylindrical inflatable device having end panels at both ends. While the device of the patent is useful for plugging of a borehole to prevent materials and personnel from falling into said borehole, the plugging device of the patent is not suitable for use according to the present invention. While the device 36 is useful, a primary teaching of the invention is that the "flat" configurations of the present inflatable devices, such as is shown in FIGS. 6 through 9, act to function in a superior manner relative to the device 36.

The inflatable devices of the invention can be formed of materials such as flexible vinyls including polyvinylchloride, low density polyethylene films and polyurethane films in varying thicknesses. The use of polyvinylchloride, other vinyls and polyethylene materials is desirable due to relatively low cost. However, such materials are less desirable from the standpoint of low temperatuare flexure and tensile strength characteristics and are more susceptible to abrasion and tearing. Aromatic polyether polyurethanes and polyester based polyurethane films are more desirable materials from the standpoint of low temperature flexure and tensile strength and lesser susceptibility to abrasion and tearing. The polyurethane films are preferred even though devices formed from such films are more costly. While polyurethane materials are preferred, it is to be understood that other materials can be utilized as long as such materials exhibit necessary characteristics. A particular material useful according to the invention is a polyester-based polyurethane film designated TF-340 which is manufactured by the Lord Film Products Division of the Lord Corporation, Erie, Pa. While varying thicknesses of the material can be utilized, it is preferred to use film materials having thicknesses of between 12 and 22 mils. Suitable physical properties for such materials include a specific gravity of approximately 1.23 (ASTM D-792), a hardness or durometer of 93 to 95 Shore A (ASTM D-2240), an ultimate tensile strength of approximately 4000 psi (ASTM D-412), an ultimate elongation of 430% (ASTM D-412), and tensile modulus values of approximately 700 psi at 100% elongation, 1300 psi at 200% elongation, and 2600 psi at 300% elongation (ASTM D-412). Such materials are preferred to exhibit a tear resistance of 400 PLI (ASTM D-624, Die C) and have a low temperature brittle point of approximately −81° F. (ASTM D-762). The materials used to form the inflatable devices of the invention are preferably colored, such as a bright orange color, so that the devices can be readily seen in a borehole. Generally, materials useful for fabrication of the inflatable devices should be tough though flexible at a wide range of temperatures and have superior solvent and petrochemical resistance.

Figure 3:
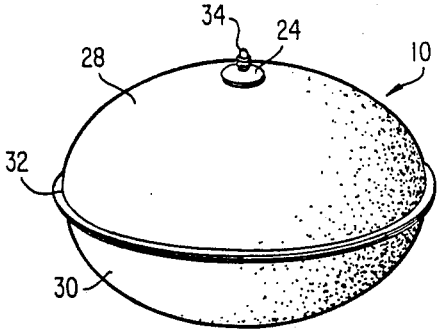
FIG. 3 is an idealized perspective view of the inflatable device of FIG. 2 after inflation and after disconnection and removal of the inflating hose, the device being shown inflated exertiorly of a borehole for purposes of illustration.
Figure 4:
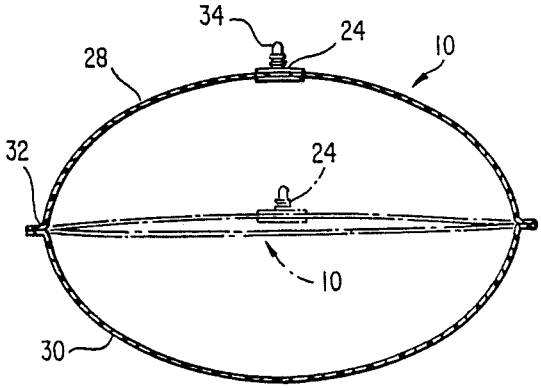
FIG. 4 is an elevational view in section of the inflated, disc-like inflatable device of FIG. 2, the deflated configuration of the device being shown in phantom.

Referring now to FIGS. 2 through 4, the inflatable device 10 is seen to be provided with at least one valve through which said devices are inflated. As has been noted relative to FIG. 2, the air hose 22 is attached to the valve 24 and used to lower the inflatable device 10 into the borehole 12 of FIG. 1A. The device 10 remains deflated while being lowered into the hole. At a desired position within the hole, air or other fluid under pressure is forced through the air hose 22 and into the inflatable device 10, thereby inflating the device. A preferred valve is a "needle" valve such as is manufactured by Halkey-Roberts, Inc., as noted above. On inflation of the device 10, the air hose 22 can be pulled from the valve 24 without dislodgement of the inflated device 10 from the borehole. A valve such as a typical tire valve having a urethane base to allow heat sealing to the device 10 can be utilized. However, release of such valves from the inflatable device 10 is not as easily accomplished as is the case in the oral valve and needle valves referred to herein. Valves of differing description can be used as long as the valves allow connection and ready removal of an air hose to the inflatable device in the event that such a connection is being used to position the inflatable devices.

The inflatable devices of the invention can be shaped and sized according to the requirements of the use situation. The inflatable device 10 of FIGS. 1 through 4 is seen to be disc-like in conformation and to comprise upper and lower circular panels 28 and 30 which are sealed about contacting perimetric edges 32 such as by heat sealing. The valve 24 is seen to be located centrally of the upper panel 28 and to have a valve nipple elements 34 to which the air hose 22 can be connected as noted above for filling of the inflatable device 10.

In FIG. 4, the inflatable device 10 is seen in phantom to be deflated and to assume a substantially flat configuration which facilitates storage of the device 10. Inflation of the device 10 externally of a borehole results in the generally ovoid shape seen in FIGS. 3 and 4. Although the inflatable device 10 is flat when deflated and essentially has no side walls, the disc-like device 10 inflates within a borehole to positively seal or "plug" the borehole to a degree which allows columns of explosives and/or stemming materials to be suspended within such a borehole. The inflatable device 10 elongates and stretches to a sufficient degree such that the device is firmly located within the borehole However, the material forming the inflatable device 10 cannot elongate to a degree that the tensile strength of the material degrades to allow splitting of the device.

The inflatable devices of FIGS. 2 through 4 and 6 through 9 in particular can be inexpensively manufactured due to a usage of a minimum amount of material for formation of the devices and the relatively reduced labor costs necessary for cutting and sealing of material used to form said devices. Even though the devices are of simple construction, said devices act to satisfactorily seal and plug boreholes with a capacity which allows practice of the methods described herein as well as other blasting methods not herein described.

FIGS. 10 through 16, 19 and 32 illustrate methods and use environments wherein the inflatable devices described above can be used to advantage. In the description of certain of these figures, the inflatable device employed will be chosen as the inflatable device 44 such as is shown in FIG. 1B, this choice being for convenience as well as for emphasis as to the deficiency of this configuration. Certain other figures will show use of the inflatable device 10 in order to show that said device 10 also has substantial potential for use.

Figure 10:
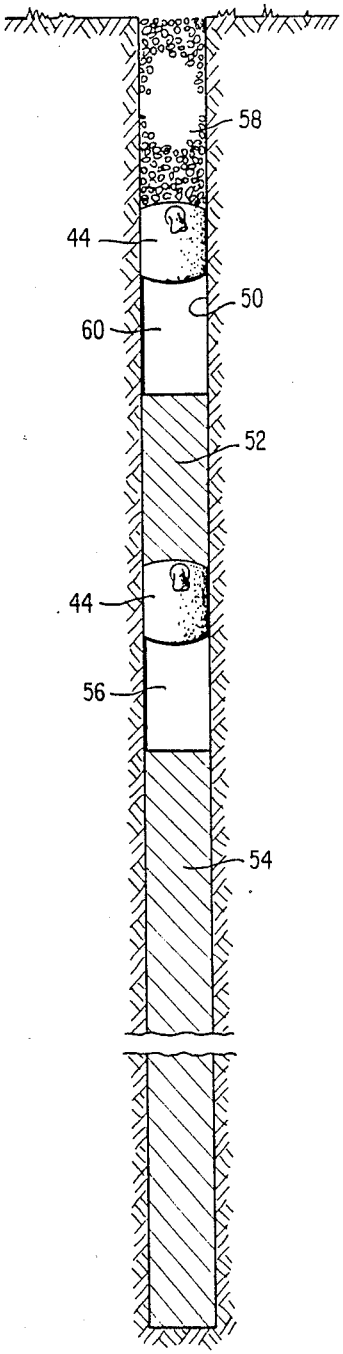
FIG. 10 is an idealized elevational view of a production borehole in partial section illustrating the use of inflatable devices according to the invention to suspend explosive charges and stemming material in spaced relation within the borehole and forming spaced air gaps therewithin.

Referring now to FIG. 10, two inflatable devices 44 are seen to be disposed within borehole 50, a lowermost device 44 being used to suspend a first explosive charge 52 in spaced relation to a second explosive charge 54 which is disposed at the bottom of the borehole 50. The lowermost device 10 is positioned to form an air gap 56 between the respective explosive charges 52 and 54. Similarly, the uppermost inflatable device 44 suspends stemming material 58 in spaced relation to the first explosive charge 52 so as to form an air gap 60 therebetween. The charge 54 comprises the major portion of the explosive material disposed within the borehole 50, the charge 54 typically comprising approximately 634 pounds of ANFO. The explosive charge 52 typically comprises approximately 178 pounds of ANFO. It is to be understood that the arrangement of FIG. 10 is primarily intended to comprise an actual production hole, a plurality of which are used for actual blast removal of overburden in a typical formation. The borehole 50 in a production situation will be approximately 58 to 60 feet deep with the charge 54 requiring approximately 25 to 30 feet of the depth of the borehole. The air gaps 56 and 60 are approximately five feet long with the charge 52 requiring about seven to ten feet of the depth of the borehole 50. The inflatable devices 44 take up some of the length of the air gaps 56 and 60. The stemming material 58 is approximately eight to ten feet in length. More than two of the inflatable devices 44 can be used, additional devices 44 being used to support additional charges of explosive material at different locations within the borehole 50. Detonation of the explosive charges 52 and 54 removes overburden from the formation. Production blasting can be used either with or without presplitting. A pattern of the production boreholes 50 is formed in the earth formation as described relative to FIG. 11.

Referring now to FIG. 11, an earth formation is seen diagrammatically at 250 to have a plurality of production holes 252 (such as the holes 50 described above) formed therein in a pattern within which said holes 252 are aligned and evenly spaced. Presplitting holes 254 (such as the holes 20 described above) are formed in the formation at a greater distance from the free edge of the formation 250 which is represented at the left side of the page. It should be noted that the production holes 252 and the presplitting holes 254 are of essentially the same diameter and are drilled using the same drilling equipemtn. Explosives within the presplitting holes 254 can be simultaneously detonated either at the same time as explosives within the production holes 252 are detonated or at a different time. The explosives within the presplitting holes 254 can be detonated well before the detonation of explosives within the production holes 252. The production holes 252 can be detonated either in vertical lines or in diagonal lines with a desired detonation order being literally milliseconds removed within the detonation pattern.

Figure 12:
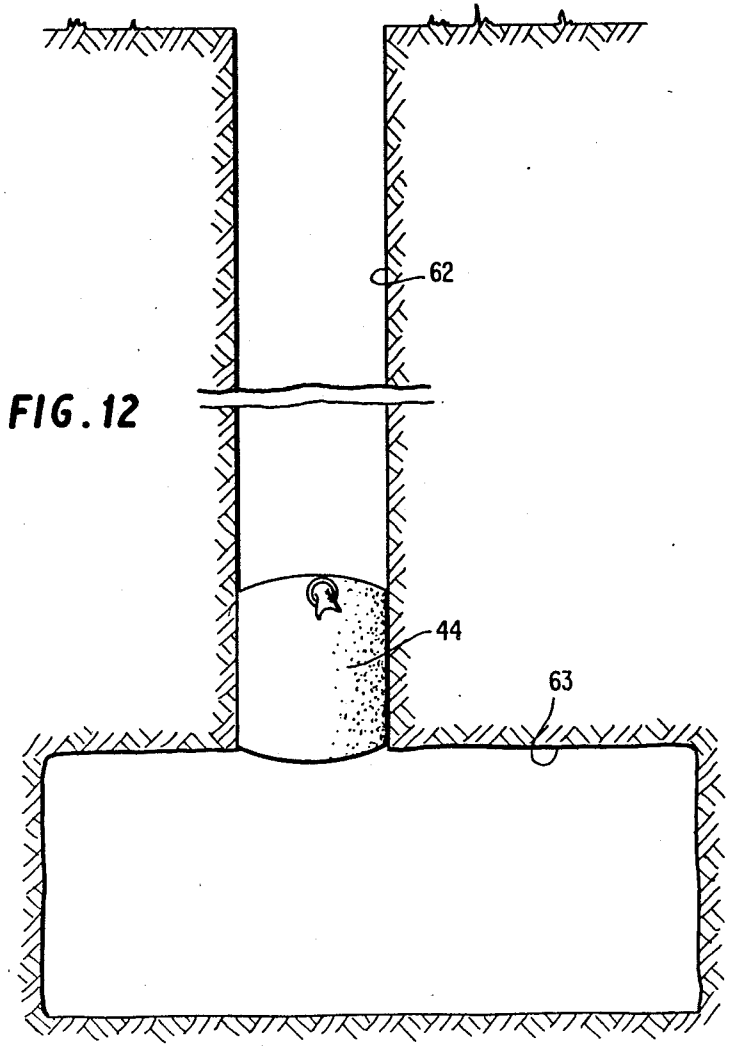
FIG. 12 is an idealized elevational view in partial section of an inflatable device according to the invention used to seal the bottom of a borehole which has been punched through an underground coal mine shaft or auger hole.

Referring now to FIG. 12, the inflatable device 44 is used to seal off the bottom of a borehole 62 which has punched through an underground coal mine, auger hole or the like represented at 63 during drilling of said borehole 62. The inflatable device 44 restores the integrity of the borehole 62 such that said borehole can be loaded with explosives which will be supported by the device 44. Once explosive (not shown) is loaded above and supported by the device 44, the borehole 62 can be used for presplitting or production blasting as has been described above. Drilling of boreholes such as the borehole 62 can frequently result in the drilling into old "works" which are typically mined out veins of coal or other minerals. Use of the inflatable device 44 provides a rapid and convenient method for blocking the bottom of the borehole 62 so that explosive charges can be loaded into the borehole. The borehole 62 is thus saved and eliminates the need for drilling a substitute borehole or for attempting to block the lower portion of the borehole with a portion of a tree trunk or with wooden plugs or the like. Accidental drilling into auger holes can similarly be handled.

Figure 13:
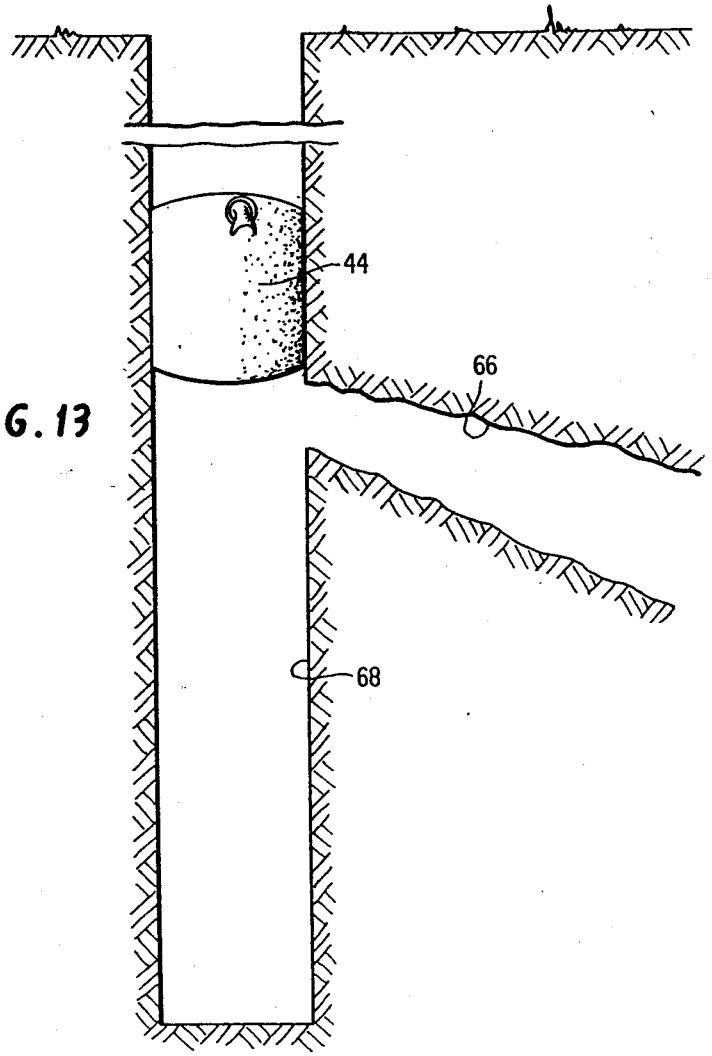
FIG. 13 is an idealized elevational view in partial section of a borehole having a lateral fissure which is sealed by means of an inflatable device according to the invention.

In FIG. 13, an earth formation which is to be blasted is seen to have a fissure 66 which comprises a crack or other void in the wall of a borehole 68. When a formation occurs having such fissures or cracks, loading of explosive material into the borehole 68 results in the seepage of explosive materials, particularly the more free flowing explosive materials, into the fissure 66. A hazard is thus created due to the fact that such fissures or cracks can absorb a substantial amount of explosive material within a relatively small area and can cause a dangerous situation on detonation of the explosive material. Typically, excessive fly rock is produced when lateral fissures or cracks become filled with explosive material which is not fully contained within the borehole 68. Solution to this problem is readily provided by disposition of the inflatable device 44 at a location within the borehole 68 such that the inflatable device 44 is slightly above the fissure. Typically, the inflatable device 44 is lowered within the borehole to a point above the fissure 66 and inflated. The remaining portion of the hole can then be loaded in a manner similar to that described relative to FIG. 12. The inflatable devices of the invention can be used in a similar situation wherein a front row of holes on a shot have been cracked by the energy of a previous blast.

Figure 14D:
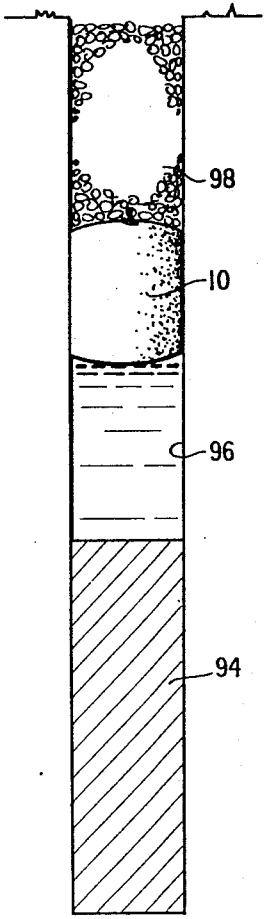
FIG. 14A through 14D are idealized elevational views in partial section of wet boreholes wherein the inflatable devices of the invention are used to deck holes having varying degrees of water fill.
Figure 14C:
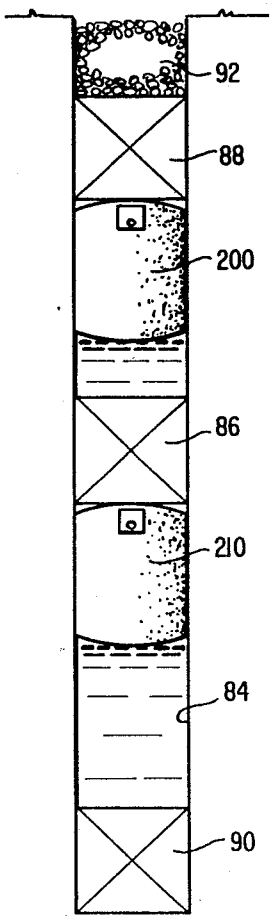
Figure 14B:
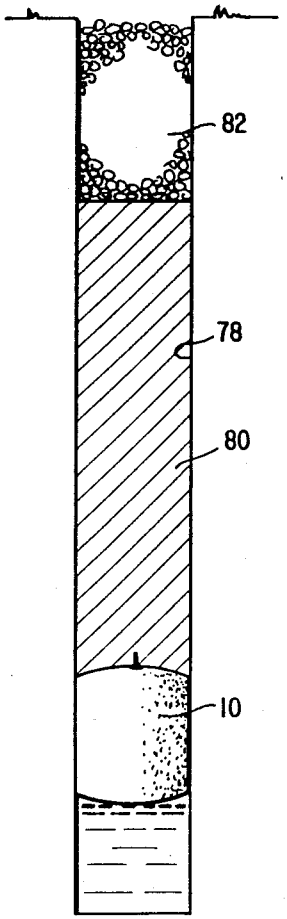
Figure 14A:
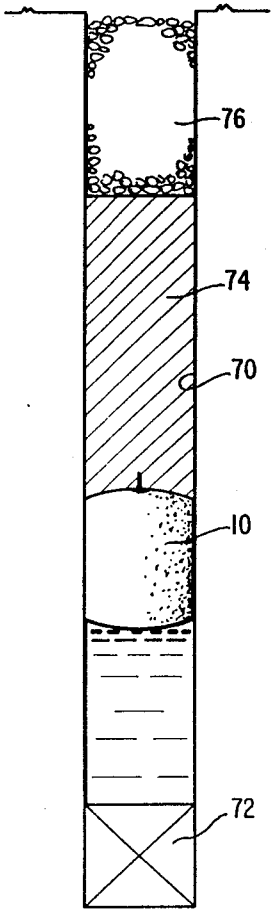

FIGS. 14A through 14D illustrate the decking of boreholes having varying amounts of water disposed within said holes. In FIG. 14A, the inflatable device 10 is used to deck a borehole 70 having less than 10% water, an explosive charge 72 being disposed in the lower portion of the hole 70 with the inflatable devcie 10 being disposed above the water and acting to suspend explosive material 74, such as ANFO, above the device 10. Stemming 76 can then be placed above the explosive material 74. In FIG. 14B, a slightly wet borehole 78 can be plugged by the inflatable device 10 near the bottom of said hole 78 to maintain water at the bottom of the hole. The device 10 suspends an explosive column 80 and stemming material 82 within said borehole 78. In FIG. 14C, a totally wet borehole is seen at 84 to have a plurality of inflatable devices 200 and 210 located within said borehole 84 to suspend explosive charges 86 and 88. An explosive charge 90 can be disposed at the bottom of the hole 84 with the hole being closed by stemming 92. In FIG. 14D, the inflatable device 10 is utilized to deck a wet hole having more than 10% water. In such a situation, an explosive column 94 can be disposed at the bottom of borehole 96 with the inflatable device 10 being used to plug the borehole at a point above the water which sits above the explosive column 94. In FIG. 14D, the inflatable device 10 acts to suspend stemming 98. Other configurations of the present inflatable devices can be used in the situations represented by FIGS. 14A through 14D. When the boreholes of FIGS. 14A through 14D are of relatively small diameters, the disc-like devices 10 can be conveniently used. For larger diameter boreholes, the devices of FIGS. 6 through 9 are preferably used.

Figure 15:
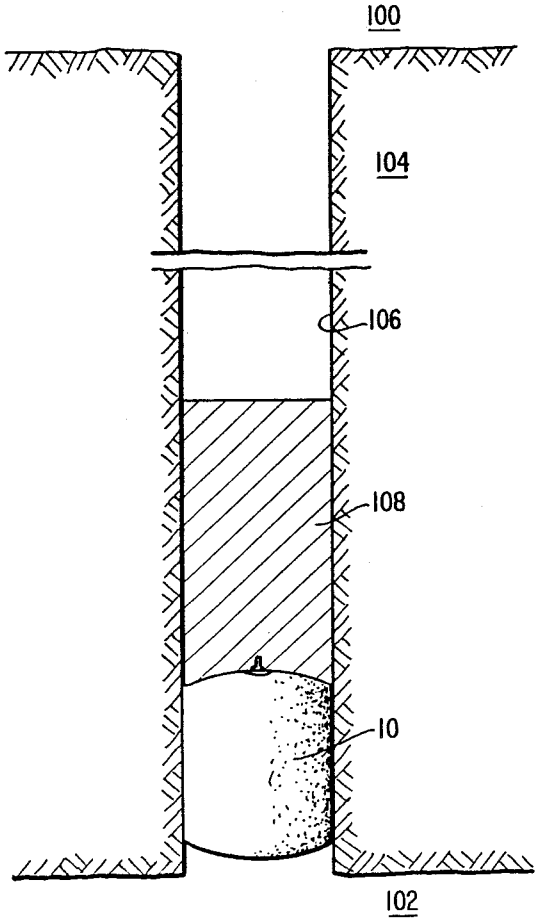
FIG. 15 is an idealized elevational view in partial section of a borehole used in vertical cratering retreat mining wherein an inflatable device according to the invention is used as a bottom plug within said borehole.

Referring now to FIG. 15, a vertical cratering retreat method is illustrated as using the inflatable device 10 as a bottom plug in an underground application. As is understood from the foregoing, other configurations of the present device can be used. In the recovery of precious metals and rare minerals, it is common in the prior art to utilize an upper room 100 and a lower room 102, the upper room being located on the top of a vein 104 with the lower room 102 being below the vein. The rooms 100 and 102 are large in size and have high "ceilings". A rotary drill (not shown) is bored into the upper room 100 and a series of holes are drilled through the vein 104 to the bottom room 102, one such borehole being shown at 106. The borehole 106 is drilled completely through the vein and is open to both the upper and lower rooms. The inflatable device 10 is lowered into the borehole 106 from the upper room and is inflated to form a support for a column 108 of explosive material which is loaded into the borehole 106 from the upper room 100. The column 108 can be fifty feet or more in length, the borehole 106 being typically up to 200 feet in length. Detonation of the columns 108 in a plurality of the boreholes 106 causes dropping of the shattered formation into the lower room 102, the shot material hen being hauled away and processed. The entire vein 104 is progressively worked down in increments of between ten and fifty feet (typically) until the vein is fully mined.

Figure 16:
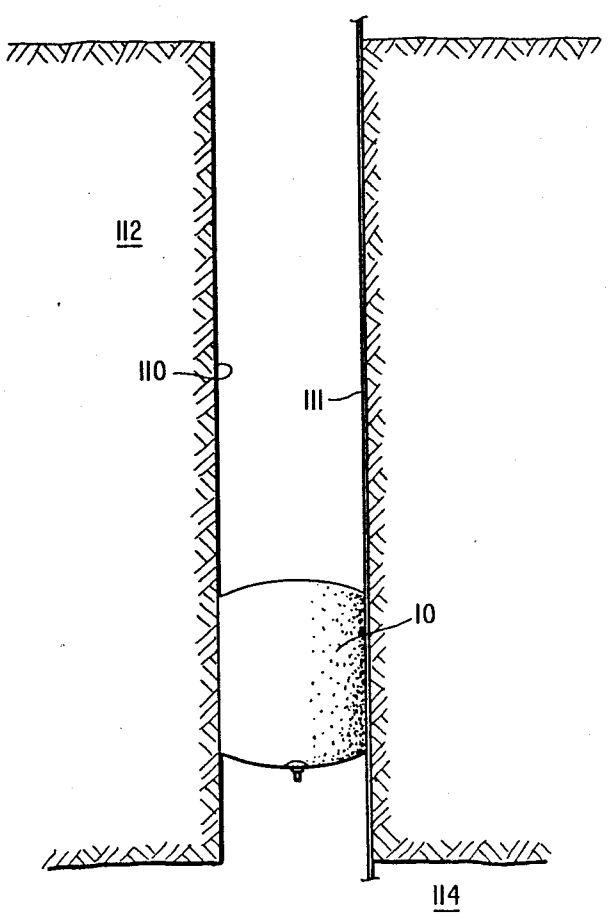
FIG. 16 is an idealized elevational view in partial section of a borehole wherein an inflatable device according to the invention is used in vertical cratering retreat mining as a blow-away plug within the borehole.

FIG. 16 illustrates a vertical cratering retreat method wherein a plurality of holes such as a hole 110 is drilled into a vein 112 from lower room 114. The inflatable device 10 is extended upwardly into the hole 110 by means of a loading pole (not shown) and inflated in place to allow an explosive column to be loaded into the hole 110 from above such as is described relative to FIG. 15.

Figure 17A:
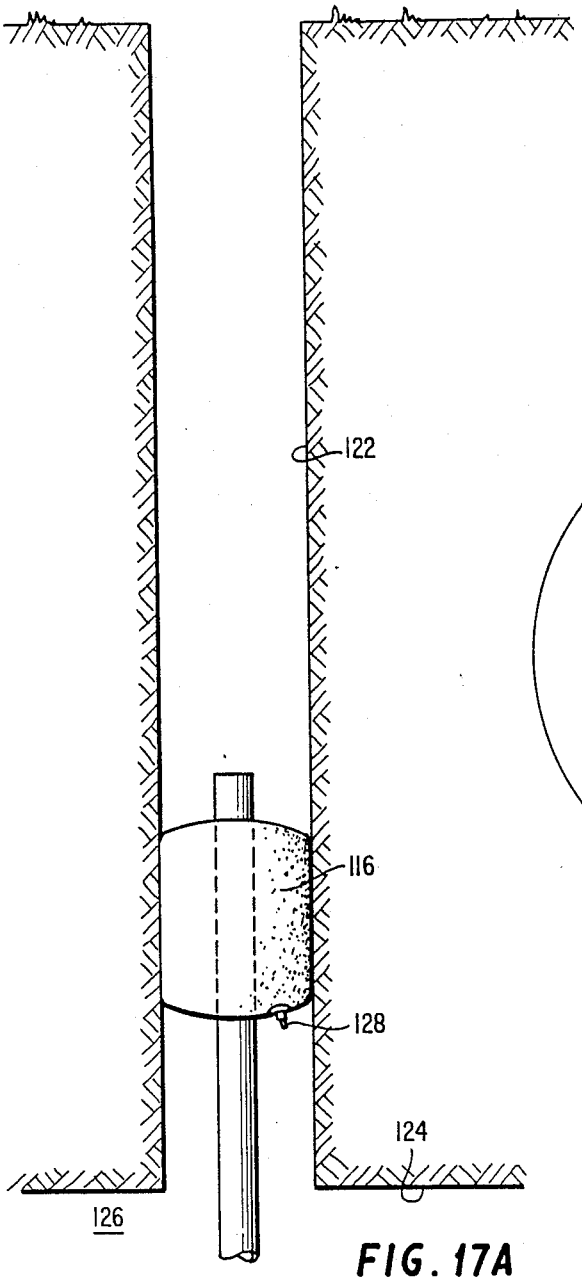
FIG. 17A is an idealized elevational view in partial section of a borehole into which slurries, emulsions, or explosives are pumped or blown up through a loading tube centered within a doughnut-shaped inflatable device according to the invention.
Figure 17B:
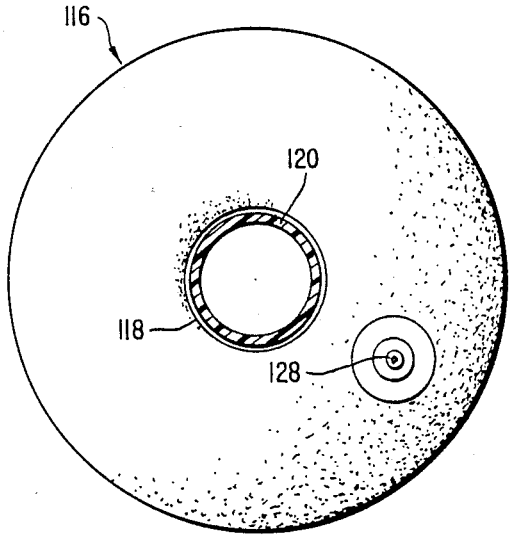
FIG. 17B is a plan view of the inflatable device of FIG. 17A showing the loading tube in section.

In FIGS. 17A and 17B, an inflatable devices 116 is seen to have an annular conformation roughly resembling a "doubhnut" in shape and having a central bore 118. A pipe 120 such as a plastic pipe is disposed through the central bore 118 while the device 116 is in a deflated condition and the assembly is extended into a borehole 122 which has been formed in the roof 124 of a mine shaft 126. Inflation of the device 116 within the borehole 122 seals said borehole and allows a slurry, emulsion or an explosive material such as ANFO to be pumped or blown upwardly through said pipe 120 for loading said borehole 122. After loading of the borehole 122, the device 116 can be deflated and removed with one of the inflatable devices 10 or 44 being then inserted into the borehole 122 and inflated to support the explosive material which has been uploaded into the borehole 122. The inflatable device 116 is provided with a valve 128 disposed on the "lower" face of the device and the device is inflated and deflated through the valve 128.

Figure 18A:
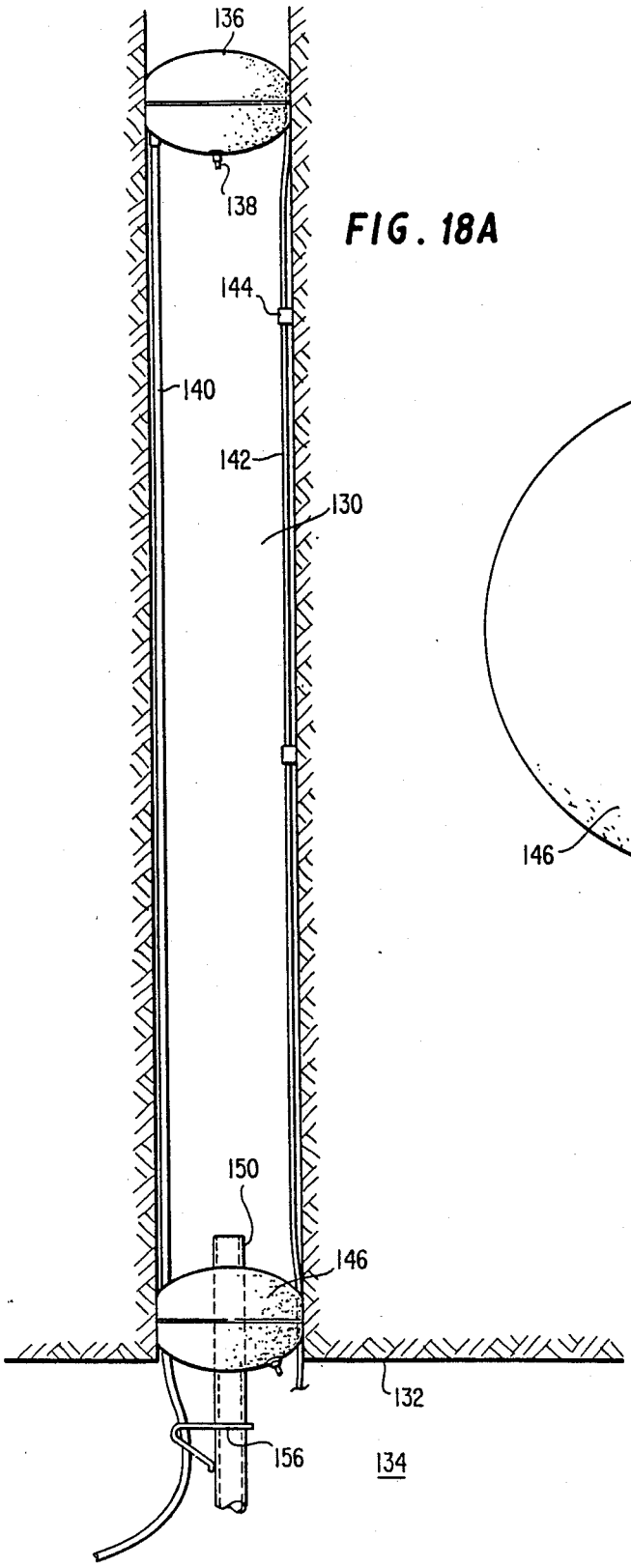
FIG. 18A is an idealized elevational view in partial section of an up hole into which explosives are loaded from below by blowing or the like and wherein inflatable devices according to the invention are utilized at the top of the hole and at the bottom of the hole, the inflatable devices accommodating air vent tubes and primer cords with attached primers for facilitating air venting on filling of the space between the inflatable devices and for accommodating a detonating cord extending between said inflatable devices and out of the hole at the bottom of said hole.
Figure 18B:
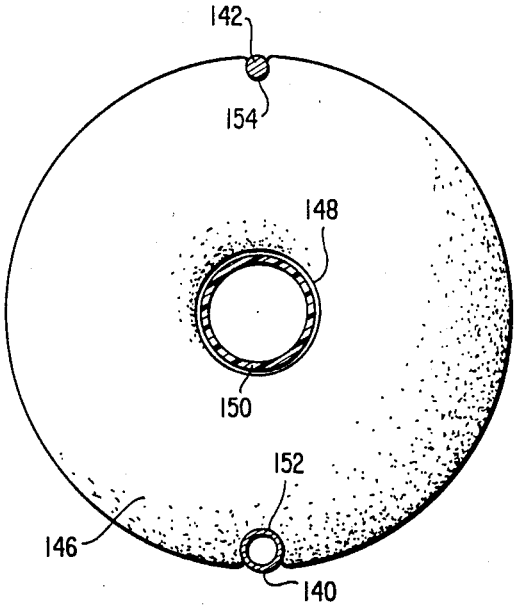
FIG. 18B is a plan view of the inflatable device of FIG. 18A showing the loading tube, the vent tube and the primer cord in section.

Referring now to FIGS. 18A and 18B, a borehole 130 is seen to be formed in roof 132 of mine shaft 134. A first inflatable device 136 is extended into the borehole 130 by means of a loading pole or the like and inflated at a location near the top of the hole 130. The device 136 is inflated through a valve 138 disposed on a "lower" face of said device. The inflatable device 136 has a vent tube 140 connected thereto, the vent tube 140 being open to ambient externally of the device 136. In essence, the vent tube 140 is preferably a flexible tube and is attached to the device 136 such that the tube 140 is carried along with the device as the device 136 is positioned at the top of the hole 130. Similarly, a primer cord 142 having primer blasting caps 144 disposed along said cord is also carried by the inflatable device 136 such that the cord 142 and caps 144 are disposed along the borehole 130. A second inflatable device 146 is located at the bottom of the borehole 130 and inflated so as to plug said borehole at the bottom thereof. The second inflatable device 146 is similar to the "doughnut" shaped device of FIGS. 17A and 17B, the device 146 having a central bore 148 through which a pipe 150 extends to allow loading of explosive material into the borehole 130 through said pipe 150, usually by pumping of emulsions or slurries forming the explosive material. Pneumatic loading of the explosive material into the space between the inflatable devices 136 and 148 requires venting of the air initially present within said borehole. Accordingly, the air is vented through the vent tube 140. The inflatable device 146 is configured to have a channel 152 formed therein such that the vent tube 140 can pass through the device 146. Similarly, a channel 154 is provided for passage of the detonating cord 142 through the inflatable device 146. On disposition of an appropriate quantity of explosive material within the borehole 130, the pipe 150 is removed and a spring clamp 156 disposed on the inflatable device 146 acts to seal the central bore 148. The inflatable device 146 thus suspends the column of explosive material located within the borehole 130 above said device 146. The arrangement of FIGS. 18A and 18B is primarily utilized when explosive material is blown into the borehole 130.

Figure 19:
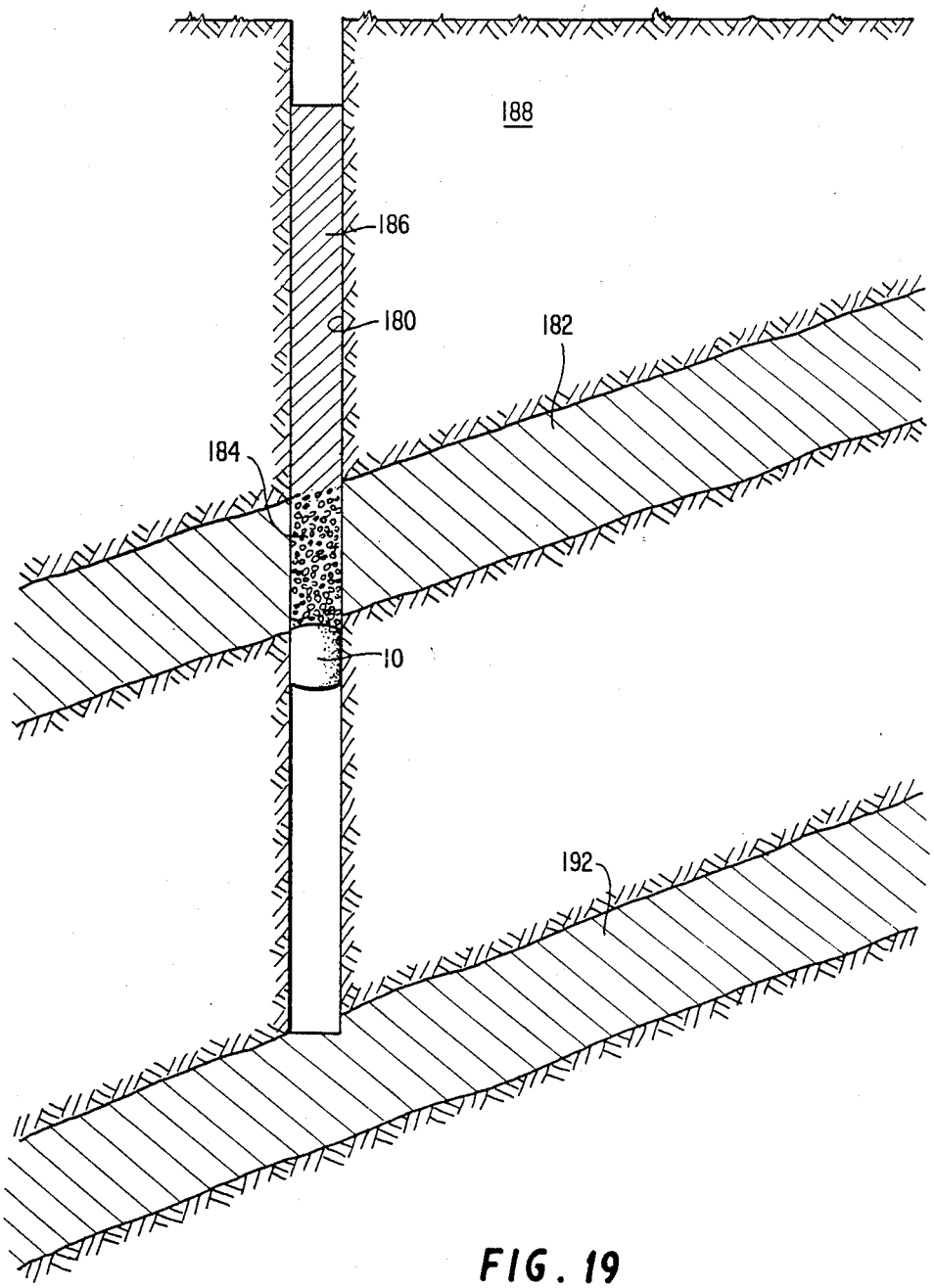
FIG. 19 is an idealized elevational view in partial section of a borehole plugged by an inflatable device according to the invention for removal of overburden over seams of material which are to be mined.

In FIG. 19, an inflatable device such as the device 10 can be used in a borehole 180 below a coal seam 182 or the like. The inflatable device 10 is disposed within the borehole 180 immediately below the location of the coal seam 182. Stemming 184 is filled into the borehole 180 in that portion of the hole which passes through the coal seam 182. Explosive material 186 is loaded into the borehole 180 above the stemming 184 and is detonated to remove overburden 188. The coal in the seam 182 is then removed after the overburden has been blasted away. After removal of the coal, the inflatable device 10 is then located and deflated for subsequent use such as for the removal of overburden 190 above coal seam 192 according to methodology identical to that relative to removal of the overburden 188 above coal seam 182. In the method shown in FIG. 19, a drill bench area is not necessary for accommodating a drill to remove the overburden from the coal seam 192 since the previously drilled hole 180 is still available for use. Underburden is similarly treated.

Figure 20:
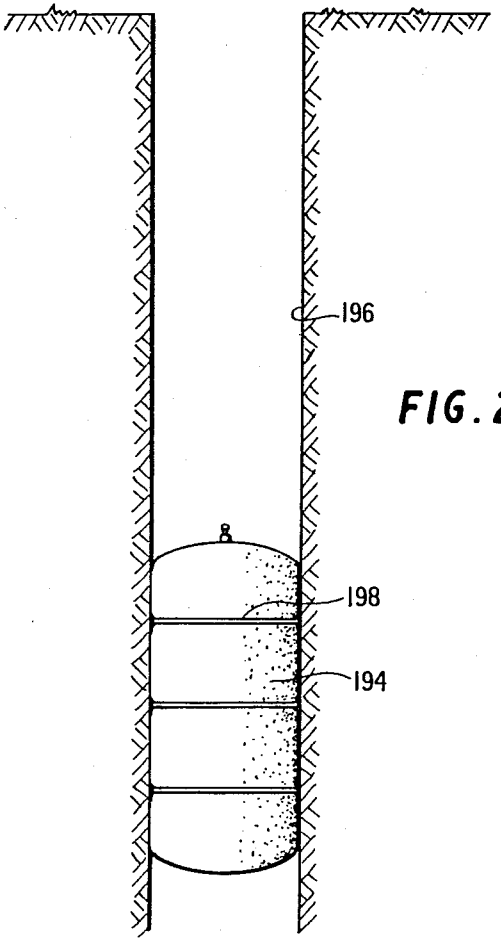
FIG. 20 is an idealized elevational view in partial section of a borehole plugged by means of an inflatable device accoding to the invention and which is useful for sealing slurries and emulsions having a watery consistency within the hole, the inflatable device having annular sealing elements disposed thereon to facilitate additional sealing.

In FIG. 20, an inflatable device 194 is seen to be substantially cylindrical in conformation although said device 194 can be otherwise formed. The inflatable device 194 is utilized in a borehole 196 which has been drilled into the roof (not shown) of a formation, the borehole 196 being typically open at its top end. Disposition and inflation of the device 194 within the borehole 196 acts to seal or "plug" the lower end of the borehole 196. When using slurries or emulsions loaded from the top of the borehole 196 and which have a watery consistency, the device 194 can be provided with seals 198 which comprise strips of a soft durometer rubber, plastic foam strips, etc., such that a more efficient sealing is provided which is adequate to suspend a more fluid explosive material. It is to be understood that the inflatable device 194 could be formed in the manner of the inflatable device 116 referred to above and provided with a central bore so that watery explosive material could be uploaded into the borehole 196. Seals such as the seals 198 provided on such an inflatable device would act to more efficiently seal the borehole 196. The seals 198 can thus function with an inflatable device regardless of the direction of loading of a borehole.

Figure 21:
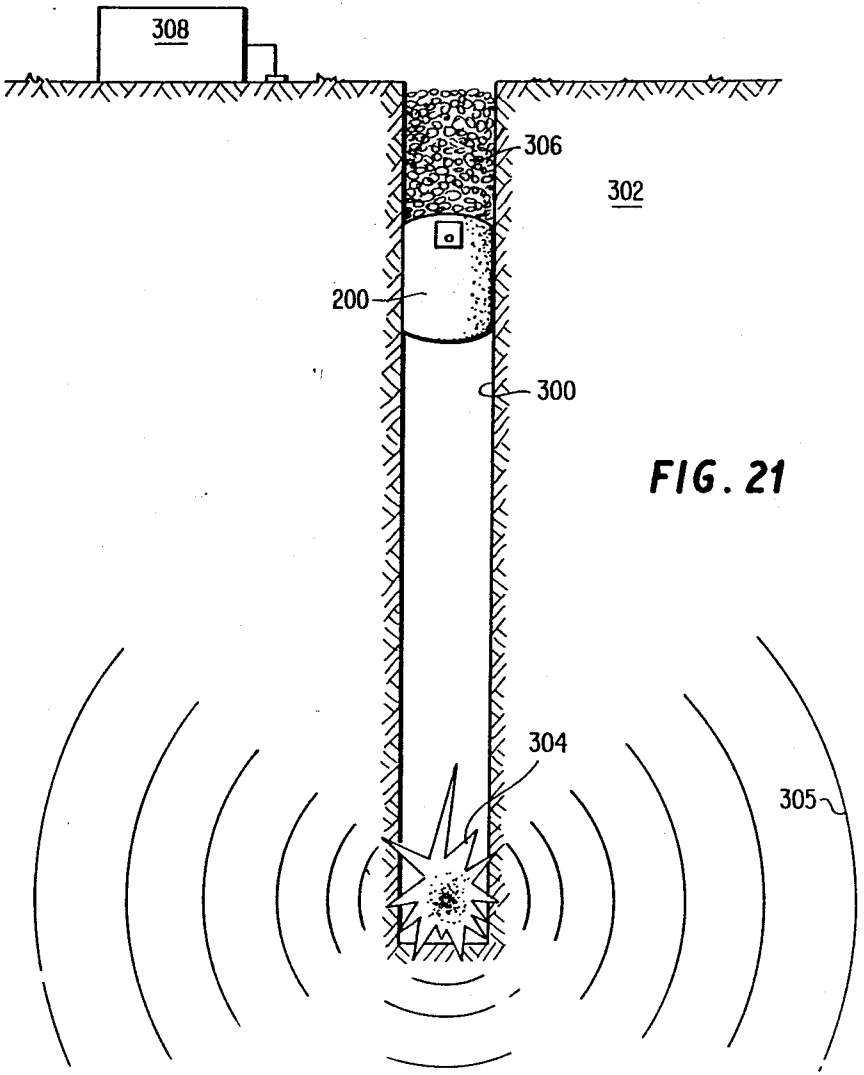
FIG. 21 is an idealized elevational view in partial section of a borehole plugged by means of an inflatable device according to the invention and whereby seismic measurements can be taken according to a method of the invention.

FIG. 21 illustrates the use of the present inflatable devices, such as the device 200, in a borehole 300 drilled into an earth formation 302 for the purpose of recording seismic measurements. Detonating explosive 304 disposed in the borehole 300 with stemming 306 supported by the device 200 causes waves 305 to be formed in the earth formation 302. Seismic measurement equipment 308 disposed externally of the borehole 300, such as on the surface of the earth formation, is used to measure the waves 305 in a known manner.

While the invention has been described relative to particular embodiments of the present inflatable devices and in light of particular methodology, it is to be understood that the invention can be practiced other than as explicitly described herein, the invention being limited only by the recitation of the appended claims.

What is claimed is:

1. A method for suspending explosive material or stemming material within a borehole, comprising:
- disposing an inflatable bag-like device within the borehole at a desired location within the borehole;
- inflating the device within the borehole with an inflation fluid to seal the device within the borehole; and,
- disposing an explosive material or stemming material within the borehole above and in contact with the inflated device.

2. The method of claim 1 wherein the bag-like device is formed of opposed planar sheets of a flexible film sealed together at perimetric edges.

3. The method of claim 2 wherein the planar sheets are circular.

4. The method of claim 2 wherein the planar sheets comprise a material having an ultimate tensile strength of between 1000 and 7000 psi and an ultimate elongation of between 200% and 600%.

5. The method of claim 4 wherein the material has a durometer of between 40 and 100 Shore A.

6. The method of claim 4 wherein the planar sheets are between 10 and 22 mils in thickness.

7. The method of claim 4 wherein the material has a tensile modulus at 100% elongation of approximately 700 psi, at 200% elongation of approximately 1300 psi and at 300% elongation of approximately 2600 psi and a tear resistance of approximately 400 PLI.

8. The method of claim 2 wherein the flexible film is between 10 and 22 mils in thickness.

9. A method for production blasting of an earth formation to remove earth from the formation, comprising the steps of:
- drilling production holes in the formation in a desired pattern;
- disposing explosive material within the holes;
- disposing inflatable bag-like devices within at least certain of the holes;
- inflating the devices to seal or plug the holes;
- disposing material above each device to suspend the material within the hole through the support provided by the device; and,
- detonating the explosive material within the holes in a desired sequence

10. The method of claim 9 and further comprising the steps of:
- drilling presplitting holes in the earth formation in a desired pattern relative to the production holes;
- disposing explosive material within the presplitting holes;
- disposing an inflatable bag-like device within each of the presplitting holes at a desired location in the holes;
- disposing stemming material above each device to suspend the stemming material within each presplitting hole through the support provided by the device; and,
- detonating the explosive material within the presplitting holes either prior to detonation of the explosive material in the production holes or substantially simultaneously therewith.

11. The method of claim 9 wherein a first relatively large quantity of explosive material is disposed in lower portions of the borehole, one of the inflatable bag-like devices is disposed within the borehole in spaced relation to the uppermost portion of the first quantity of explosive material, thereby forming an air gap between the device and the first quantity of explosive material, a second relatively small quantity of explosive material is disposed above and supported by the device, a second inflatable bag-like device is disposed within the borehole in spaced relation to the uppermost portion of the second quantity of explosive material, thereby forming an air gap between said device and the second quantity of explosive material, and stemming material is disposed above and supported by the second device.

12. The method of claim 9 wherein the sequence of detonation is simultaneous detonation of the explosive material within the holes.

13. The method of claim 9 wherein the bag-like devices are formed of opposed planar sheets or a flexible film sealed together at perimetric edges.

14. The method of claim 13 wherein the planar sheets are circular.

15. A method for presplitting of an earth formation, comprising the steps of:

drilling presplitting holes in the earth formation in a desired pattern;

disposing explosive material within the presplitting holes;

disposing an inflatable bag-like device within each of the presplitting holes at a desired location in the holes;

disposing stemming material above each device to suspend the stemming material within each presplitting hole through the support provided by the device; and, detonating the explosive material within the presplitting holes.

16. The method of claim 15 wherein the bag-like devices are formed of opposed planar sheets of flexible film sealed together at perimetric edges.

17. The method of claim 16 wherein the planar sheets are circular.

* * * * *

US004913233C1

(12) EX PARTE REEXAMINATION CERTIFICATE (4998th)

United States Patent
Fitzgibbon, Jr.

(10) Number: US 4,913,233 C1
(45) Certificate Issued: Oct. 19, 2004

(54) METHODS OF FIELD BLASTING OF EARTH FORMATIONS USING INFLATABLE DEVICES FOR SUSPENDING EXPLOSIVES IN BOREHOLES

(75) Inventor: Daniel F. Fitzgibbon, Jr., Rte. 3, Van Dyke Mill Rd., Taylorsville, KY (US) 40071

(73) Assignee: Daniel F. Fitzgibbon, Jr., Simpsonville, KY (US)

Reexamination Request:
No. 90/006,488, Dec. 18, 2002

Reexamination Certificate for:

| | |
|---|---|
| Patent No.: | **4,913,233** |
| Issued: | **Apr. 3, 1990** |
| Appl. No.: | **07/276,651** |
| Filed: | **Nov. 28, 1988** |

Related U.S. Application Data

(62) Division of application No. 07/166,542, filed on Mar. 10, 1988, now Pat. No. 4,919,203.

(51) Int. Cl.[7] ..... E21B 33/127

(52) U.S. Cl. ..... 166/285; 166/187; 166/192; 102/313

(58) Field of Search ..... 166/297, 285, 166/286, 292, 381, 386, 63, 187, 191, 192, 179; 175/2, 4.52, 4.57, 4.59, 65; 102/304, 311, 312, 313, 333; 138/93; 299/2, 13

(56) References Cited

U.S. PATENT DOCUMENTS

| | | | | | |
|---|---|---|---|---|---|
| 3,106,159 | A | * | 10/1963 | Abramson | 102/333 |
| 3,130,787 | A | | 4/1964 | Mason | 166/187 |
| 3,613,784 | A | | 10/1971 | Bassani | 166/187 |
| 3,806,025 | A | | 4/1974 | Marshall | 229/62.5 |
| 4,303,273 | A | * | 12/1981 | Ricketts | 299/2 |
| 4,353,598 | A | * | 10/1982 | Ricketts | 299/2 |
| 4,359,246 | A | * | 11/1982 | Ricketts | 299/2 |
| 4,440,447 | A | * | 4/1984 | Ricketts et al. | 299/2 |
| 4,444,433 | A | * | 4/1984 | Ricketts | 299/2 |
| 4,545,622 | A | | 10/1985 | Yang | 299/2 |
| 4,633,946 | A | * | 1/1987 | Jackson | 166/187 |
| 4,674,570 | A | * | 6/1987 | Jackson | 166/187 |
| 4,736,796 | A | * | 4/1988 | Arnall et al. | 166/292 |
| 4,813,358 | A | * | 3/1989 | Roberts | 102/313 |
| 4,846,278 | A | | 7/1989 | Robbins | 166/286 |

OTHER PUBLICATIONS

Cedrick E. Gregory, *Explosives for North American Engineers,* Series on Rock and Soil Mechanics, vol. 1, No. 4, 1971/1973, pp. 176–180.

U. Langefors et al., *Smooth Blasting and Presplitting,* The Modern Technique of Rock Blasting, Published by John Wiley & Sons, Inc., 1963, pp. 296–320.

* cited by examiner

*Primary Examiner*—David Bagnell

(57) ABSTRACT

The invention provides methods and apparatus useful primarily in the presplitting and blast removal of earth formations, the improvements according to the invention involving the use of inflatable devices suspended in boreholes used in shattering earth formations. The inflatable devices of the invention can be of various shapes and are provided with valves to allow a fluid such as air to be pumped into each device on placement of the device at a desired location in a borehole. The inflatable devices are preferably formed of a flexible, polymeric material which allows a desired degree of stretching to cause plugging of a borehole. The "plug" formed by an inflatable device of the invention allows loading of explosives into a borehole in order to produce desired blast results according to the several methods of the invention.

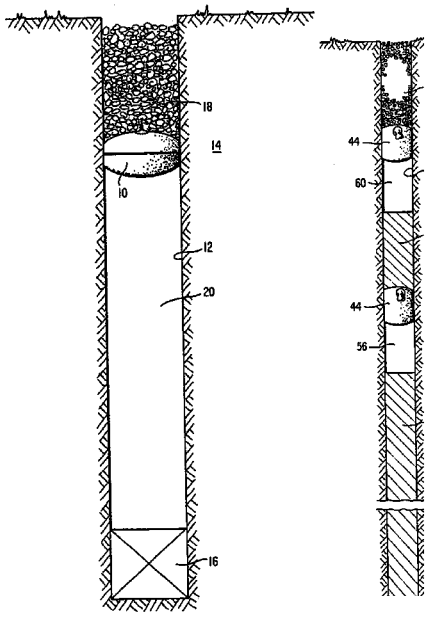

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–17 is confirmed.

Claim 1 is determined to be patentable as amended.

Claims 2–8, dependent on an amended claim, are determined to be patentable.

1. A method for suspending explosive material [or stemming material] within a borehole, comprising:

disposing an inflatable bag-like device within the borehole at a desired location within the borehole;

inflating the device within the borehole with an inflation fluid to seal the device within the borehole; and, disposing an explosive material [or stemming material] within the borehole above and in contact with the inflated device.

* * * * *